US008568046B2

(12) United States Patent
Campbell et al.

(10) Patent No.: US 8,568,046 B2
(45) Date of Patent: Oct. 29, 2013

(54) MOUNTING ASSEMBLY AND METHOD OF LOADING AND/OR UNLOADING ROLLS

(75) Inventors: Donald A. Campbell, Johnson City, NY (US); Donald J. Ward, Sayre, PA (US)

(73) Assignee: Avery Dennison Corporation, Pasdena, CA (US)

( * ) Notice: Subject to any disclaimer, the term of this patent is extended or adjusted under 35 U.S.C. 154(b) by 793 days.

(21) Appl. No.: 11/901,404

(22) Filed: Sep. 17, 2007

(65) Prior Publication Data

US 2009/0072073 A1 Mar. 19, 2009

(51) Int. Cl.
*B41J 15/00* (2006.01)

(52) U.S. Cl.
USPC ..... 400/613; 400/611

(58) Field of Classification Search
USPC ..... 400/613
See application file for complete search history.

(56) References Cited

U.S. PATENT DOCUMENTS

| | | | | |
|---|---|---|---|---|
| 2,681,189 | A | 12/1946 | Huber | |
| 2,622,818 | A | 5/1950 | Faris et al. | |
| 3,730,452 | A | 5/1973 | Schwartz | |
| 3,770,549 | A | 11/1973 | Carbone | |
| 3,797,772 | A * | 3/1974 | Lucas | 242/573.7 |
| 3,799,465 | A | 3/1974 | Erny | |
| 3,837,690 | A | 9/1974 | Fraser, Jr. et al. | |
| 3,877,656 | A * | 4/1975 | Suzaki | 242/597.3 |
| 4,083,516 | A * | 4/1978 | Schuch et al. | 242/597.3 |
| 4,436,249 | A * | 3/1984 | Santa Lucia et al. | 242/484.6 |
| 4,615,494 | A | 10/1986 | Focke et al. | |
| 4,750,660 | A * | 6/1988 | Kamimura | 242/615.3 |
| 4,984,915 | A | 1/1991 | Tashiro et al. | |
| 5,232,174 | A | 8/1993 | Sato et al. | |
| 5,645,247 | A | 7/1997 | Voigt | |
| 5,683,058 | A | 11/1997 | Schwartz et al. | |
| 5,785,270 | A | 7/1998 | Buchko | |
| 5,879,092 | A * | 3/1999 | Brannan et al. | 400/708 |
| 5,984,544 | A | 11/1999 | Lippold et al. | |
| 6,095,704 | A * | 8/2000 | Jaeger et al. | 400/613 |
| 6,155,517 | A | 12/2000 | Lippold et al. | |

(Continued)

FOREIGN PATENT DOCUMENTS

| | | | |
|---|---|---|---|
| DE | 3723592 | A1 | 1/1989 |
| DE | 19913100 | A1 | 10/1999 |
| EP | 0 360 400 | | 3/1990 |
| JP | 62-167919 | | 7/1987 |

(Continued)

OTHER PUBLICATIONS

"Headlights Shine Between—Not Through—Raindrops", Photonics.com; Jul. 10, 2012.

*Primary Examiner* — Anthony Nguyen
(74) *Attorney, Agent, or Firm* — Avery Dennison Corporation

(57) ABSTRACT

There is disclosed a printer including a print head and a mounting assembly for a web roll having a core. The mounting assembly can center-justify the roll with respect to the print head. The roll can be loaded simply by pushing the roll slidably onto the mounting assembly and unloaded by pulling the roll or its core slidably off the mounting assembly using one hand. In some embodiments, there is no need separately to undo any latch or to free the roll or its core from any latch other than by pushing or pulling on the roll or the core. In another embodiment, one of the stops is pivoted either to trap the core between the one stop and another stop or to enable the core to be slid onto the support to a position between the stops or to be slid off the support.

14 Claims, 12 Drawing Sheets

(56) References Cited

U.S. PATENT DOCUMENTS

| | | | | |
|---|---|---|---|---|
| 6,302,604 | B1 | 10/2001 | Bryant et al. | |
| 6,622,622 | B2 * | 9/2003 | Lee et al. | 101/228 |
| 6,923,582 | B2 * | 8/2005 | Pomfret | 400/242 |
| 6,948,294 | B2 * | 9/2005 | Rabiea | 53/459 |
| 7,261,254 | B2 * | 8/2007 | Mindler | 242/597.3 |
| 7,306,785 | B2 * | 12/2007 | Brogan | 424/9.363 |
| 2005/0258301 | A1 | 11/2005 | Hirte et al. | |

FOREIGN PATENT DOCUMENTS

| | | |
|---|---|---|
| JP | 02-110055 | 4/1990 |
| JP | 02-233442 | 9/1990 |
| JP | 02-249845 | 10/1990 |
| JP | 04-006009 | 12/1990 |
| JP | 04-045043 | 2/1992 |
| JP | 06-072597 | 3/1994 |
| JP | 10-181964 | 7/1998 |
| JP | 11-139638 | 5/1999 |

* cited by examiner

MOUNTING ASSEMBLY AND METHOD OF LOADING AND/OR UNLOADING ROLLS

BACKGROUND

1. Field

The embodiments relate to mounting assemblies for rolls of webs and to method of loading and/or unloading rolls.

2. Brief Description of the Prior Art

The following patent documents are made of record: U.S. Pat. No. 2,622,818; U.S. Pat. No. 2,681,189; U.S. Pat. No. 4,615,494; U.S. Pat. No. 3,730,452; U.S. Pat. No. 3,770,549; U.S. Pat. No. 3,799,465; U.S. Pat. No. 3,837,690; U.S. Pat. No. 4,984,915; U.S. Pat. No. 5,232,174; U.S. Pat. No. 5,645,247; U.S. Pat. No. 5,683,058; U.S. Pat. No. 5,785,270; U.S. Pat. No. 5,984,544; U.S. Pat. No. 6,155,517; U.S. Pat. No. 6,302,604; U.S. Pat. No. 6,622,622; U.S. 2005/0258301; EPO 0 360 400; German OS 37 23 592 A1; German OS 199 13 100 A1; Japan 62-167919; Japan 4-6009; Japan 4-45043; Japan 6-72597; Japan 2-110055; Japan 2-233442; Japan 2-249845; Japan 10-181964; and Japan 11-139638.

SUMMARY

An embodiment of a mounting assembly includes a cantilevered support having an inner end portion and an outer end portion, the support being capable of slidably receiving and mounting a core for web material, a first stop at the inner end portion, a second stop at the outer end portion, wherein the second stop is deflectable and includes a first engageable surface, the roll being positionable between and in contact with the first stop and the engageable surface of the second stop, and wherein the core cooperates with the first engageable surface and deflects the second stop upon sliding the core off the support.

An embodiment of a mounting assembly includes a cantilevered support, a pair of stops disposed along the support, one of the stops being yieldable and having a first engageable cam surface, the stops being spaced apart and capable of straddling a core for web materials, the core having opposite ends capable of engaging the stops, and wherein one end of the core is cooperable with the first cam surface to cam the yieldable stop out of the way as the core is slid off the support.

An embodiment of a mounting assembly includes a cantilevered support, a pair of stops disposed along the support, a core having opposite ends capable of engaging the stops, one of the stops being yieldable, a cam surface on at least one of the yieldable stops and the core, the stops being spaced apart and capable of straddling a core for web material, and wherein one end of the core is cooperable with the yieldable stop so that core can cam the yieldable stop out of the way as the core is slid off the support.

An embodiment of a mounting assembly comprises a longitudinally extending support having an axis, an inner end portion and an outer end portion, and a longitudinally extending slot, a shaft extending along the axis within the support and having oppositely threaded portions, the support being capable of slidably receiving and mounting a hollow core for web material, wherein the core has an internal projection capable of being received in the slot, a first stop disposed at the inner end portion of the support and received on one threaded portion and extending into the slot, a second stop disposed at the outer end portion of the support and threadably received on the other threaded portion and extending into the slot, the second stop being shiftable between a first position out of alignment with the projection so that the core can be slid onto or off the support and a second position wherein the second stop is aligned with the projection to hold the core captive between the first and second stops.

An embodiment of a mounting assembly comprises a longitudinally extending support having an axis and an axially extending slot, a shaft extending along the axis within the support and having a threaded portion, the support being capable of slidably receiving and mounting a hollow core for web material, wherein the core has an internal projection capable of being received in the slot, a first stop and a second stop, the second stop being threadably received on the threaded portion and extending into the slot, the second stop being shiftable between a first position out of alignment with the projection so that the core can be slid onto or off the support and a second position wherein the stop is aligned with the projection to hold the core captive between the first and second stops.

In the disclosed embodiments of mounting assemblies, rolls of different widths can be center-justified between stops. The center-justification can be with respect to a print head and other components such as an unwind. In the event the stops are set at a spacing for a particular width roll or core, there is no need to adjust the spacing of the stops for other rolls or cores of the same width.

The embodiments are simple to construct and to use and have relatively few parts. For example, a roll or a core can be both loaded and unloaded from a mounting assembly simply by sliding the roll or the core onto or off the mounting assembly using one hand. One of the stops is simply pushed out of the way as the roll or the core is being slid both onto and off the mounting assembly. There is no need to separately unlatch the roll or core.

An embodiment of a method comprises providing a support to receive and mount a core for web material, the core having an internal projection, a shaft having oppositely threaded portions, a first stop threadably received on one threaded portion and a second stop threadably received on the other threaded portion, the support having a slot capable of receiving the internal projection, the second stop being rotatable between a first position out of alignment with the projection and a second position in alignment with the projection, positioning the second stop in the first position; loading the core onto the support, and rotating the second stop to second position to capture the core between the stops.

An embodiment of a method comprises providing a support to receive and mount a core for web material, the support having a slot, the core having an internal projection, a shaft received within the support and having a threaded portion, a first stop and a second stop between which the core can be received, the second stop being disposed in the slot and threadably received on the threaded portion, the second stop being rotatable between a first position out of alignment with the projection and a second position in alignment with the projection, positioning the second stop in the first position, loading the core onto the support and, rotating the second stop to the second position to capture the core between the stops.

A method embodiment includes providing a rotatable, cantilevered support to slidably receive and mount a core for web material, a pair of stops at spaced locations along the support and cooperable with opposite ends of the core, the stops being relatively movable in unison to enable center-justification of the core on the support, wherein one of the stops is yieldable, positioning a core between the stops, and unloading the core from the support by sliding the core against and over the yieldable stop.

A method embodiment includes providing a cantilevered support to enable a core for web material to be slidably loaded onto and unloaded from the support, a pair of stops between which the core can be positioned, one of the stops being yieldable, sliding the core onto the support against and over the yieldable stop to cause the yieldable stop to yield to enable the core to be slid to a position between the stops, and thereafter sliding the core against and over the yieldable stop to cause the yieldable stop to yield as the core is unloaded from the support.

A method embodiment includes providing a cantilevered support to enable a core for web material to be slidably loaded onto and unloaded from the support, a pair of stops between which the core can be positioned, one of the stops being yieldable, and unloading the core by sliding the core against the yieldable stop to move the stop out of the way.

BRIEF DESCRIPTION OF THE DIAGRAMMATIC DRAWINGS

DETAILED DESCRIPTION OF THE PREFERRED EMBODIMENTS

Figure 1:
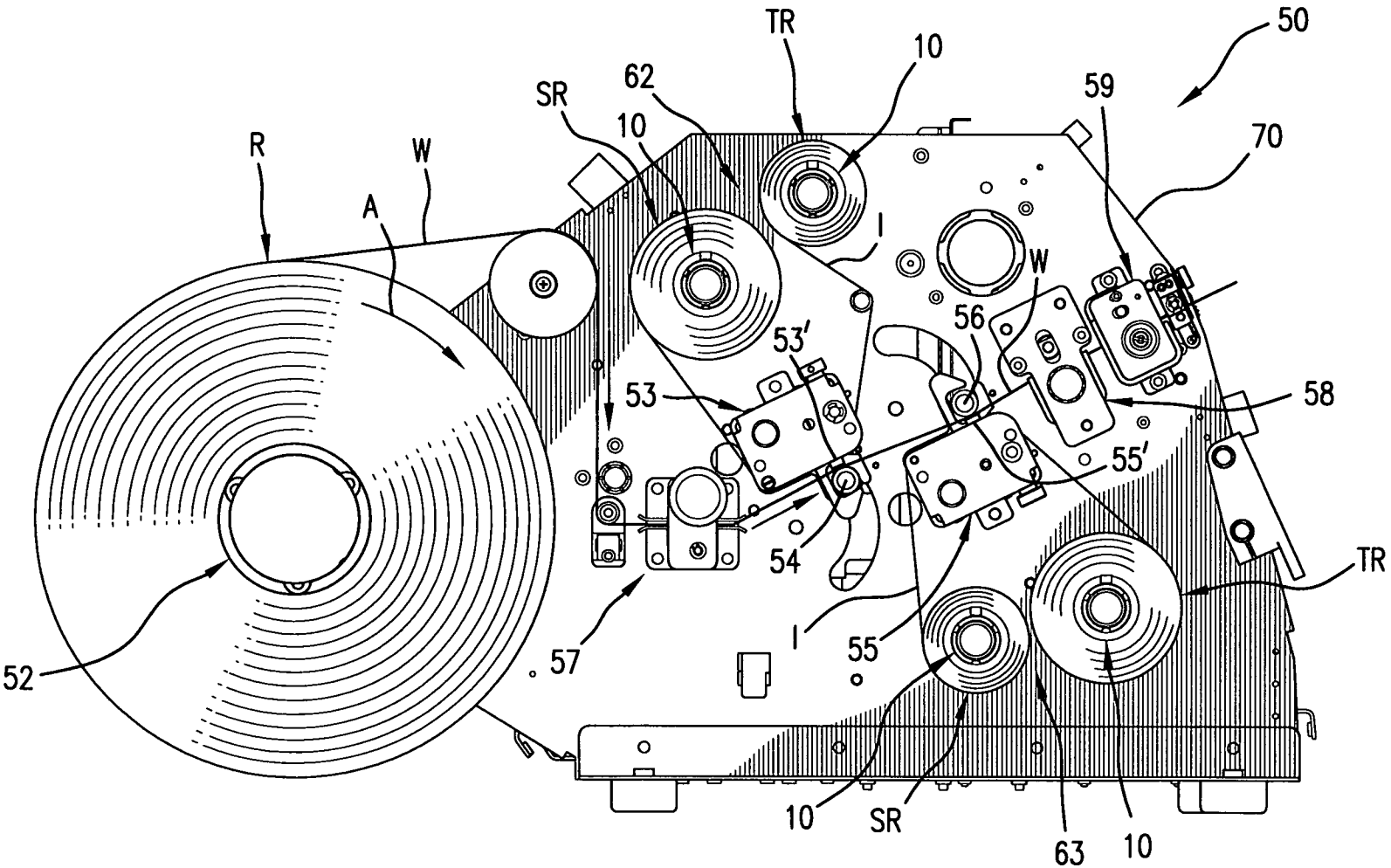
FIG. 1 is a side elevational view of a printer having mounting assemblies.

With reference initially to FIG. 1, there is shown a printer generally indicated at 50 for printing on a printable web W. The printer 50 is similar in many respects to the printer 50 disclosed in U.S. Pat. No. 7,125,182 incorporated herein by reference in its entirety. The same reference characters are used herein as in U.S. Pat. No. 7,125,182 to the extent possible. A stacker (not shown) can be used with the printer 50. The web W is initially in the form of a wound supply roll R mounted on an unwind mechanism generally indicated at 52. The web W is drawn through the printer 50 in the direction of arrows shown along the path of the web W. As the web W is paid out of the web roll R, the web roll R rotates clockwise in the direction of arrow A. The unwind mechanism or unwind 52 applies a slight tensioning force to the web W by an electric motor (not shown) attempting to rotate the roll R counterclockwise, that is, in a direction opposite to the direction of the arrow A. However, the force exerted on the web W to feed the web W through the printer 50 overcomes the force exerted by the unwind mechanism 52 to enable the web W to be fed through the printer 50. By this arrangement the web W is always maintained under the desired tension.

The printer 50 can include a print head assembly 53 and a cooperable platen in the form of a platen roll 54. The printer 50 also can include another print head assembly 55 and a cooperable platen in the form of a platen roll 56. The print head assembly 53 and the platen roll 54 may be termed a "first" print head assembly and the "first" platen roll, respectively, because they are upstream of the print head assembly 55 and the platen roll 56. Similarly, the print head assembly 55 and the platen roll 56 are downstream of the print head assembly 53 and the platen roll 54 and may be termed the "second" print head assembly and the "second" platen roll. The print head assemblies 53 and 55 are identical and the platen rolls 54 and 56 are identical. The print head assemblies 53 and 55 are secured to the frame plate 70 by screws (not shown).

A thermal print head 53' at a side of the print head assembly 53 cooperates with the platen roll 54 to print on the upper side or surface of the web W. A thermal print head 55' at a side of the print head assembly 55 cooperates with the platen roll 56 to print on the lower surface of the web W. The platen rolls 54 and 56 are shown in their respective latched positions in FIG. 1.

The platen rolls 54 and 56 are preferably non-driven or idler rolls. During operation of the printer 50, a feed mechanism generally indicated at 58 feeds the web W from the roll R past a guide mechanism generally indicated at 57 to between the print head 53' and the platen roll 54 and to between the print head 55' and the platen roll 56. From there the web W passes to a cutter or cutter mechanism 59. The cutter 59 cuts the web W into predetermined length sheets, in particular labels or tags L. The labels or tags L can be fed to a stacker (not shown).

It is preferred that the printer 50 be of the thermal transfer type, wherein ink ribbons I pass between the thermal print heads 53' and 55' and the web W. A first ink ribbon system 62 is associated with the first print head assembly 53 and the platen roll 54, and a second ink ribbon system 63 in associated with the second print head assembly 55 and the platen roll 56. The ink ribbon systems 62 and 63 are identical. The systems 62 and 63 each have two mounting assemblies 10 of identical construction. Each supply roll SR and each take-up roll TR is mounted on a mounting assembly 10. It is to be understood that the mounting assemblies 10 of the supply rolls SR carry a supply of a web I of ink ribbon. Initially, the mounting assemblies 10 of the take-up rolls TR are only empty cores C onto which the spent ink ribbon web I will be wound as the printer 50 uses ink ribbon I to print on the web W. As the webs I of ink ribbon I are being paid out of the supply rolls SR, each spent ink ribbon web I is wound onto its take-up core C on the mounting assembly 10 of the take-up roll TR. When an ink ribbon web I has been expended from a supply roll SR the filled take-up roll TR is removed and disposed of and the empty supply roll core C is loaded onto the mounting assembly 10 for the take-up roll TR. Then a new roll of ink ribbon web I is loaded onto the mounting assembly 10 for the supply roll SR. Each supply roll SR and each take-up roll TR is driven by a mechanism best shown in FIG. 24 of U.S. Pat. No. 7,125,182. Each system 62 and 63 is microprocessor controlled.

Figure 2:
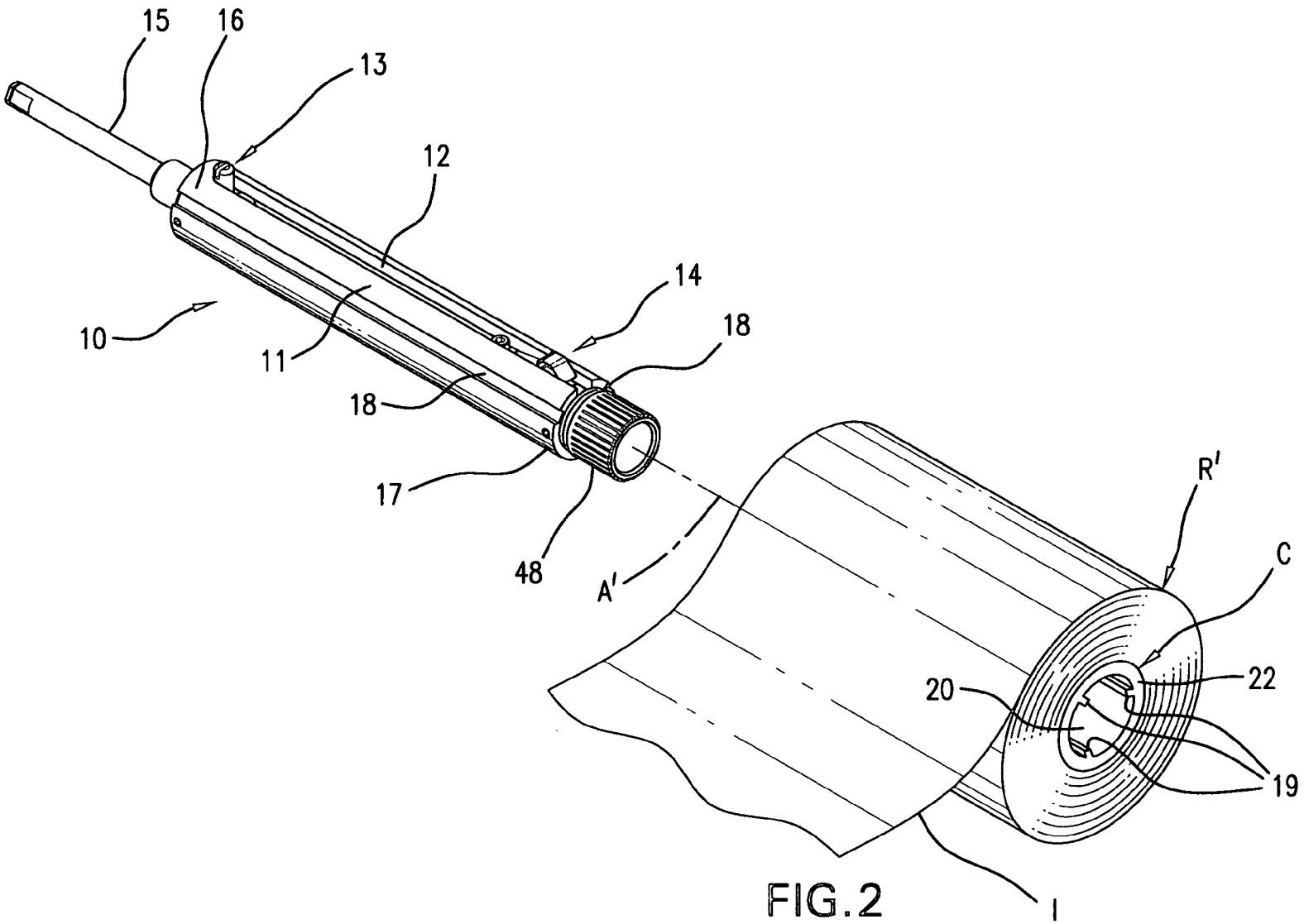
FIG. 2 is a pictorial view of a mounting assembly and a roll of a web.

With reference to FIG. 2, there is shown a mounting assembly 10 and a roll R' of a web I wound on a core C. The core C is shown generally aligned with the mounting assembly 10 along an axis A' as it would be preparatory to loading the roll R' onto the mounting assembly 10. The roll R' can be either a supply roll SR or a take-up roll TR.

The mounting assembly 10 is shown to include a support 11 having an axially extending slot 12. The support 11 is generally tubular or right circular cylindrical. A pair of stops 13 and 14 is disposed and spaced along the support 11 at the slot 12. A shaft 25 (FIG. 3) extends between end portions 16 and 17 of the support 11 and into a manually-engageable knob 48. The support 11 can have one or more external grooves 18 for receiving internal projections shown to be ribs 19 on the inner annular through-hole or inner surface 20 of the core C. If desired, the projections 19 can extend the entire distance between opposite ends 21 and 22 (FIG. 4) of the core C. The projections 19 and grooves 18 cooperate to key the core C to the support 11 against relative rotation, it being apparent that one groove 18 and one projection would serve the keying function but a greater number, as for example, three is more user-friendly.

Figure 3:
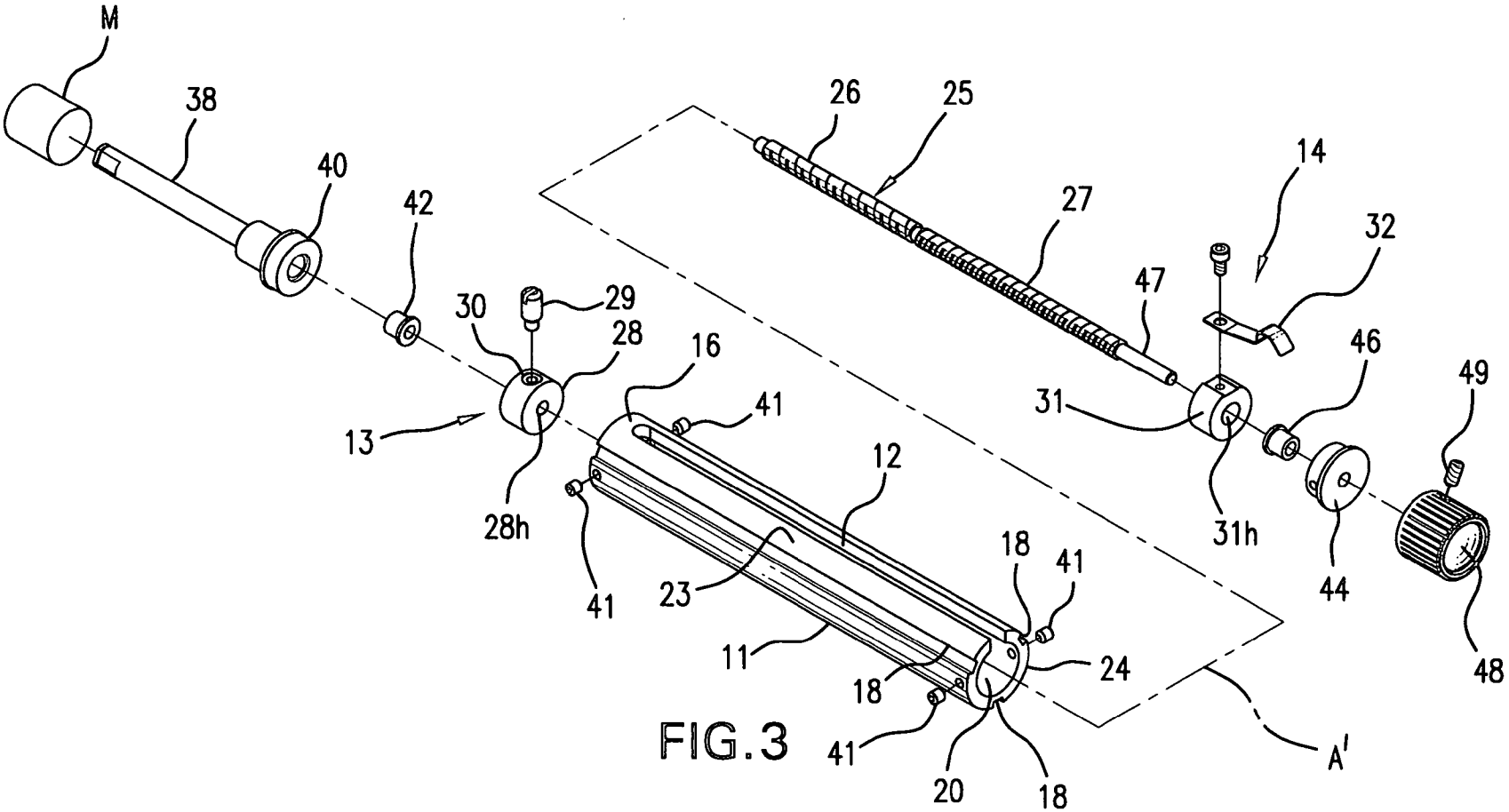
FIG. 3 is an exploded perspective view of the mounting assembly which is shown in assembled form in FIG. 2.
Figure 4:
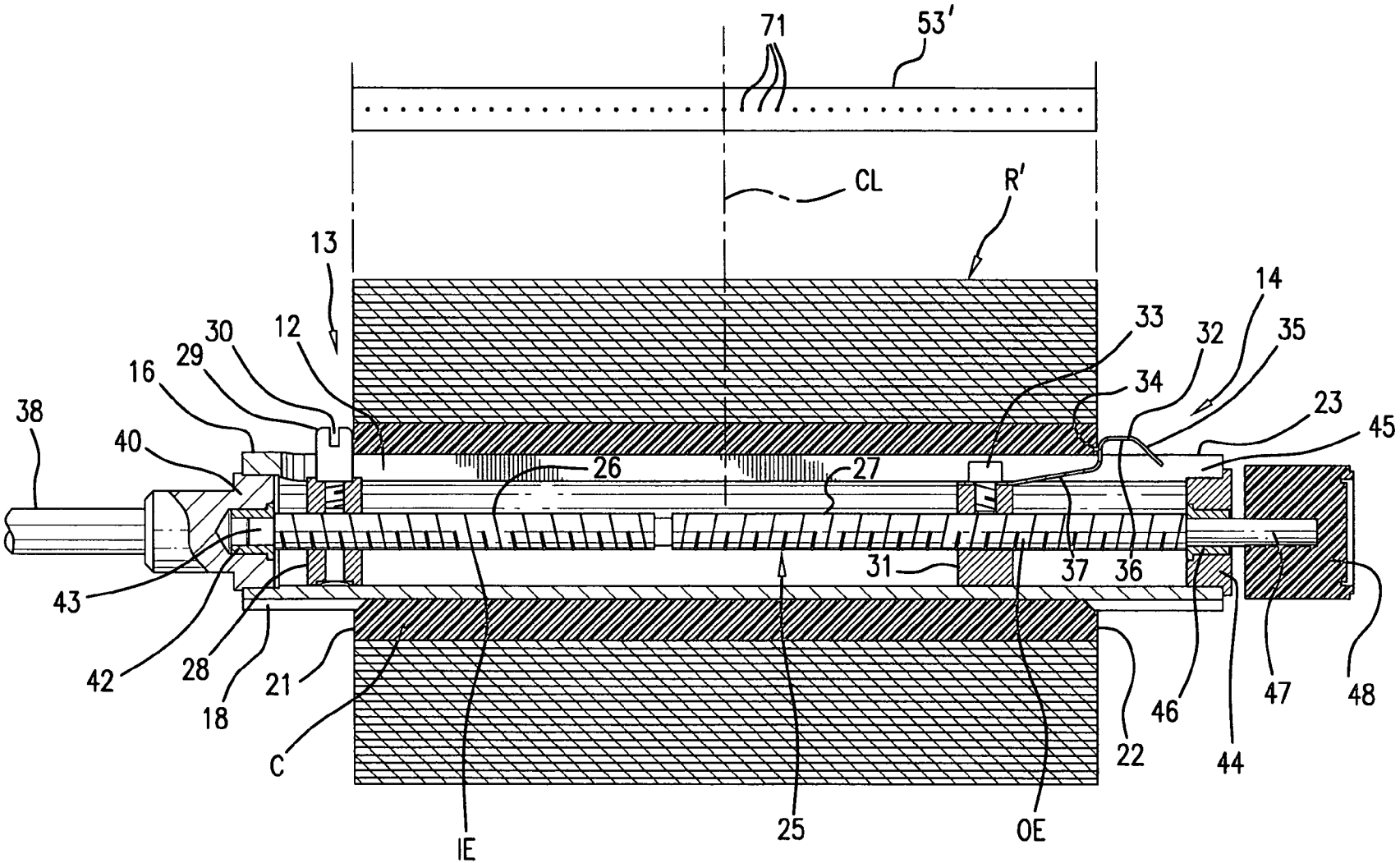
FIG. 4 is a sectional view through the mounting assembly and the roll which it mounts, wherein the roll is center-justified with respect to a print head.

With reference to FIGS. 3 and 4, the support 11 is shown to be generally tubular with a generally annular inner surface 20 and a generally annular outer surface 23. The slot 12 can be open at end 24 of the support. The slot 12 can terminate or be closed at end portion 16.

An axially extending shaft generally indicated at 25 is shown to have oppositely threaded portions 26 and 27. The threaded portion 26 can have a left-hand thread and the portion 27 can have a right-hand thread, or vice versa. The pitch of the threads on the threaded portions 26 and 27 is preferably the same for center-justification purposes. A nut or block 28 is threadably received on the threaded portion 26 at a threaded hole 28*h*. A stop member 29 of the stop 13 is threadably received in the nut 28. The stop member 29 is received in and projects above the slot 12 as best shown in FIG. 4. The stop member 29 is guided for axial movement along the slot 12 and the slot 12 prevents rotation of the stop member 29 and the nut 28 relative to the support 11. As shown in FIG. 4, end 21 of the core C is against the stop member 29. The stop member 29 can have a screw-driver slot 30 to aid in assembly.

Figure 5:
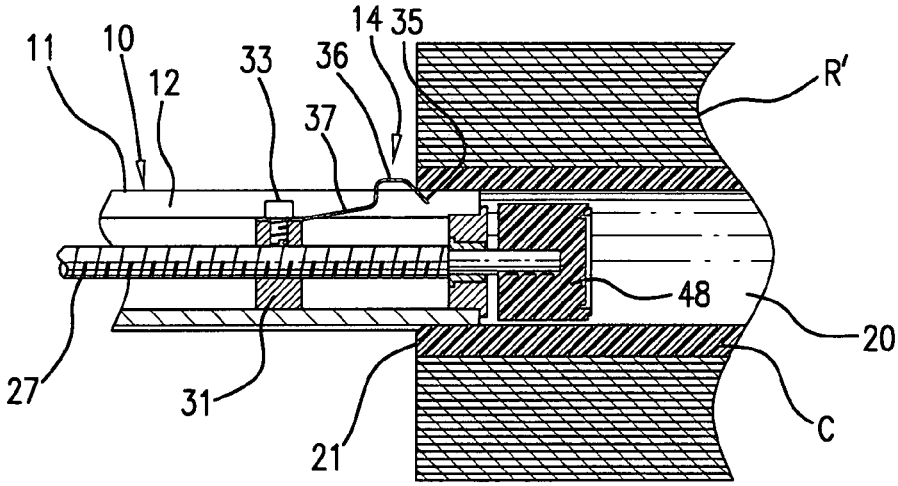
FIG. 5 is a fragmentary sectional view showing the core of the roll just contacting a yieldable stop while being loaded onto a support.
Figure 6:
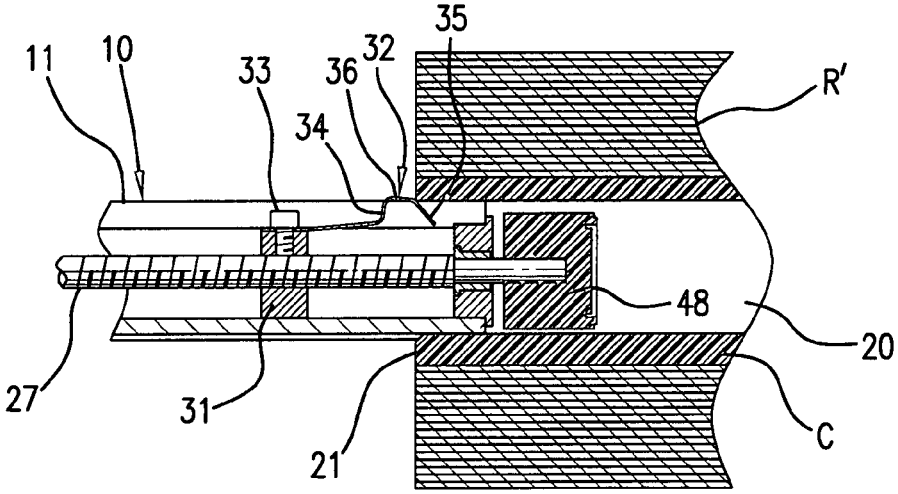
FIG. 6 is a fragmentary sectional view showing the core as having caused the yieldable stop to yield after the core has been slid further onto the support.

The threaded portion 27 threadably receives a nut or block 31 having a threaded axial hole 31*h*. A yieldable or deflectable stop 14, which can take the form of a spring finger 32, is mounted to the nut 31 by a screw 33. The spring finger 32 can be considered to comprise a detent. The spring finger 32 is guided in the slot 12 for axial movement when the shaft 25 is rotated. Neither the stop 13 nor the stop 14 can rotate about the axis A' relative to the support 11. The general location of the stop 13 is at inner end portion IE portion of the shaft 25 and the general location of the stop 14 is out outer end portion OE of the shaft 25. As shown in FIGS. 4, 5 and 6, the spring finger 32 can project above the outer periphery or surface 23 of the support 11 into the slot 12. As seen especially in FIGS. 4 through 7, the spring finger 32 can have an engageable surface or surface potion 34 which can engage or abut terminal end 22 of the core C. The surface portion 34 can be considered to have a cam surface or a surface which can be engaged or pushed out of the way by terminal end 22 of the core C. The spring finger 32 also can have an engageable surface or surface portion 35 which can engage or abut terminal end 22 of the core C as shown in FIGS. 5 and 6. The surface portion 35 can be considered to be a cam surface or a surface which can be engaged and pushed out of the way by terminal end 21 of the core C. The spring finger 32 can also have a dwell or connecting portion 36 which connects or bridges and preferably provides a smooth transition between the surface portions 34 and 35. The surface portion 34 is connected to the nut 31 by an arm portion 37. Thus, the spring finger 32 is cantilevered to the nut 31. The surface portion 34 can be considered to be a first surface portion and the surface portion 35 can be considered to be a second surface portion.

The support 11 is mounted on a shaft 38 which is coupled to a motor M (FIG. 3). The shaft 38 includes a hub 40 secured in the opening 20 at end portion 16 (FIG. 4). The mounting assembly 10 can be cantilevered or cantilever-mounted by the shaft 38. The hub 40 is secured in the end portion by set screws 41. A bushing 42 is press-fitted onto the hub 40. End portion 43 of the shaft 25 is rotatably mounted in the bushing 42. A hub 44 is received in marginal end portion 45 of the support 11. The hub 44 is secured in the end portion 16 by set screws 41. A bushing 46 is press-fitted into the hub 44 and rotatably mounts annular, thread-free end portion 47 of the shaft 25. The knob 48 is secured to the end portion 47 by a set screw 49.

FIG. 4 shows the roll R' including its core C as center-justified with respect to the print head, for example the print head 53'. The print head 53' is illustrated to show a linear array of the dot heating elements 71 which are closely spaced for example at 300 dots or heating elements per one inch (2.54 cm). Thus, centerline CL is the centerline for each of the roll R', the core C and the print head 53'. It is noted that because the pitch of the threads on the threaded portions 26 and 27 is the same, when the knob 48 is turned relative to the support 11, the nuts 28 and 31 move together or apart in unison and through equal and opposite distances. So the core C or the roll R' can always be brought into center-justification relative to the print head. In the specific embodiment, the web R' is an ink ribbon I. By rotating the knob 48, the ink ribbon web I can track center-justified with respect to the print heads 53' and 55' and the unwind 52.

Figure 7:
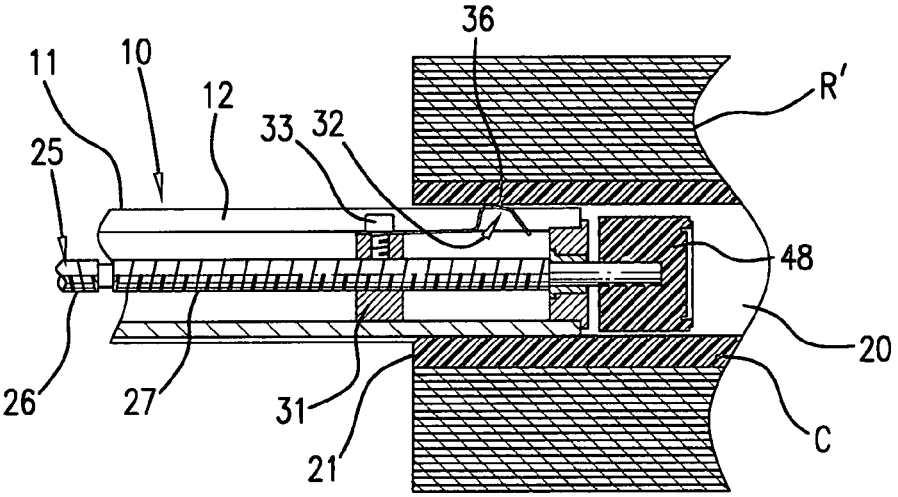
FIG. 7 is a fragmentary sectional view showing the core holding the yieldable stop out of the way.

FIG. 2 shows the roll R' spaced from the mounting assembly 10. Before the roll R' is mounted or loaded onto the mounting assembly 10, the knob 48 can be rotated so that the stops 13 and 14 are spaced apart widely enough so that the roll R' can be slid onto the mounting assembly 10 to a position wherein the roll R' is straddled by and between the stops 13 and 14. If the stops 13 and 14 are already spaced apart to center-justify the core C, as in FIG. 4, then there is no need to adjust the knob 48 to, in turn, adjust the positions of the stops 13 and 14. FIG. 5 shows the roll R' being loaded or mounted onto the mounting assembly 10. Terminal end 21 of the core C is shown to just touch the cam or engageable portion 35 of the stop 14. At this position the core C has not caused any deflection or yielding of the spring finger 32. FIG. 6 shows that the core C has moved further to the left and has deflected the stop 14 almost to its full extent. FIG. 7 shows that the core C has moved even further to the left to a position where the dwell portion 36 contacts and can ride against the inner surface 20 of the core C. The spring finger 32 has been fully deflected to position out of the way. When the roll R' and its core C have moved to the left of the position shown in FIG. 7 to the position shown in FIG. 4, the spring finger 32 springs back to almost its free position best shown in FIGS. 2 and 5 so that the surface portion 34 is in the path of the core C. In the FIG. 4 position the spring finger 32 is flexed to a certain extent to exert a force against the core C to releasably hold the core C in place. At this point the core C is releasably held between the stops 13 and 14. If the stops 13 and 14 are spaced apart more widely than the terminal ends 21 and 22 of the core C, then the knob 48 can be turned to move the stops 13 and 14 toward each other until the stops 13 and 14 engage ends 21 and 22 of the core C. Movement of the stops 13 and 14 toward each other can also shift the core C on the support 11 to bring the core C into center-justification as stated hereinabove. Once the core C of a certain width is engaged by and between the stops 13 and 14, the core C and the roll R' remains center-justified on the mounting assembly 10, the spacing of the stops 13 and 14 need not be changed when like-size rolls are subsequently mounted on the mounting assembly 10. It can happen that a user uses the same width rolls repeatedly so there is no need to adjust the positions of the stops for rolls of the same width. Thus, the mounting assembly 10 can be repeatedly used without adjustment of the stops 13 and 14. It is only when the width of the roll changes that the spacing between the stops 13 and 14 needs to be changed to accommodate a wider or narrower roll.

To remove or unload a roll R' or a core C from the mounting assembly 10, the user can grasp and slide the roll R' or the core C to the right as viewed in FIG. 4 for example. The terminal end 22 of the core acts on the portion 34 to deflect the stop 14 to the FIG. 7 position where the stop 14 is out of the way. Upon continued movement to the right as viewed in FIGS. 4 and 7, the roll R' and/or the core C is or are slid off the mounting assembly 10.

Figure 8:
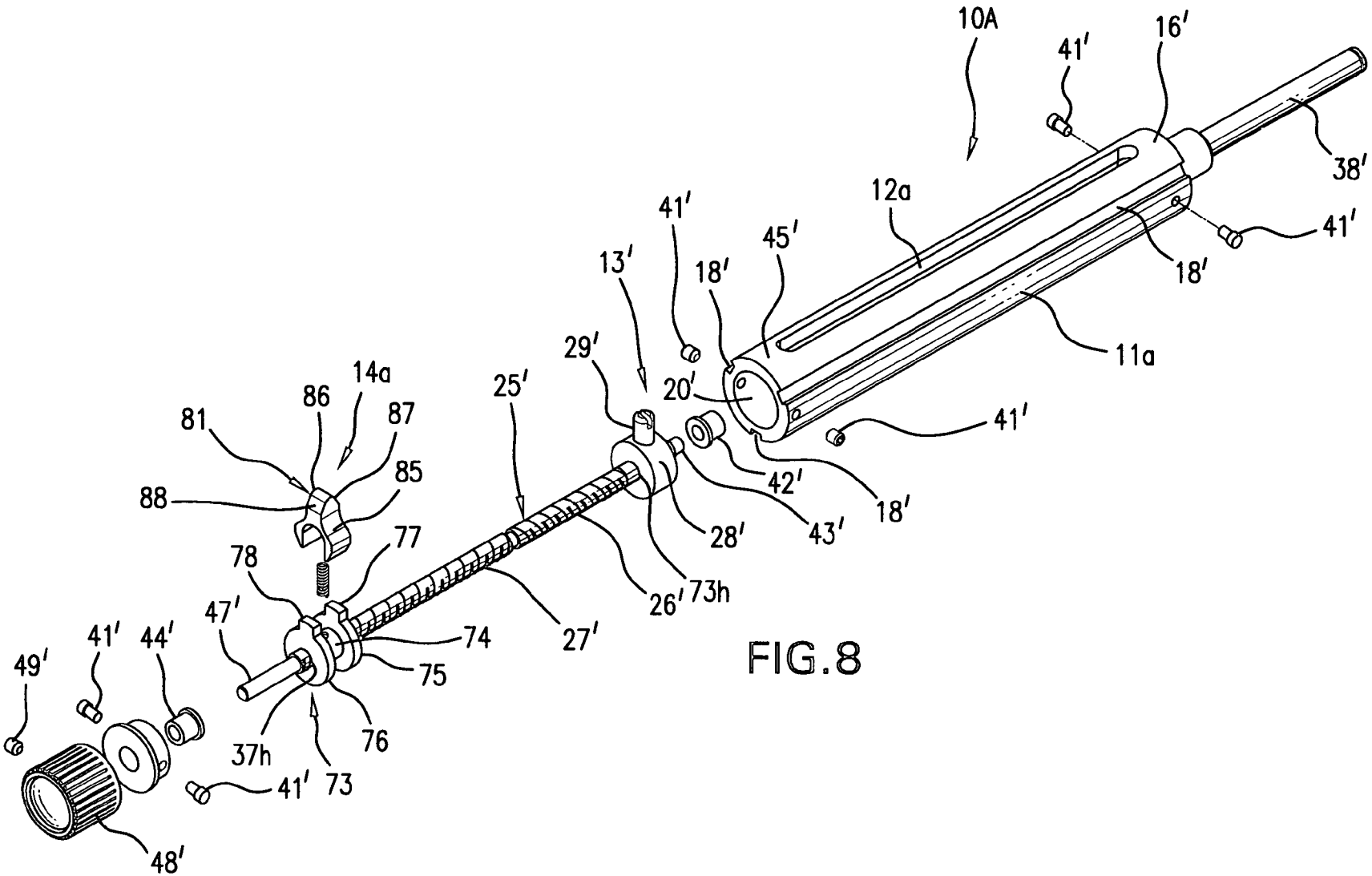
FIG. 8 is an alternative embodiment of mounting assembly.
Figure 9:
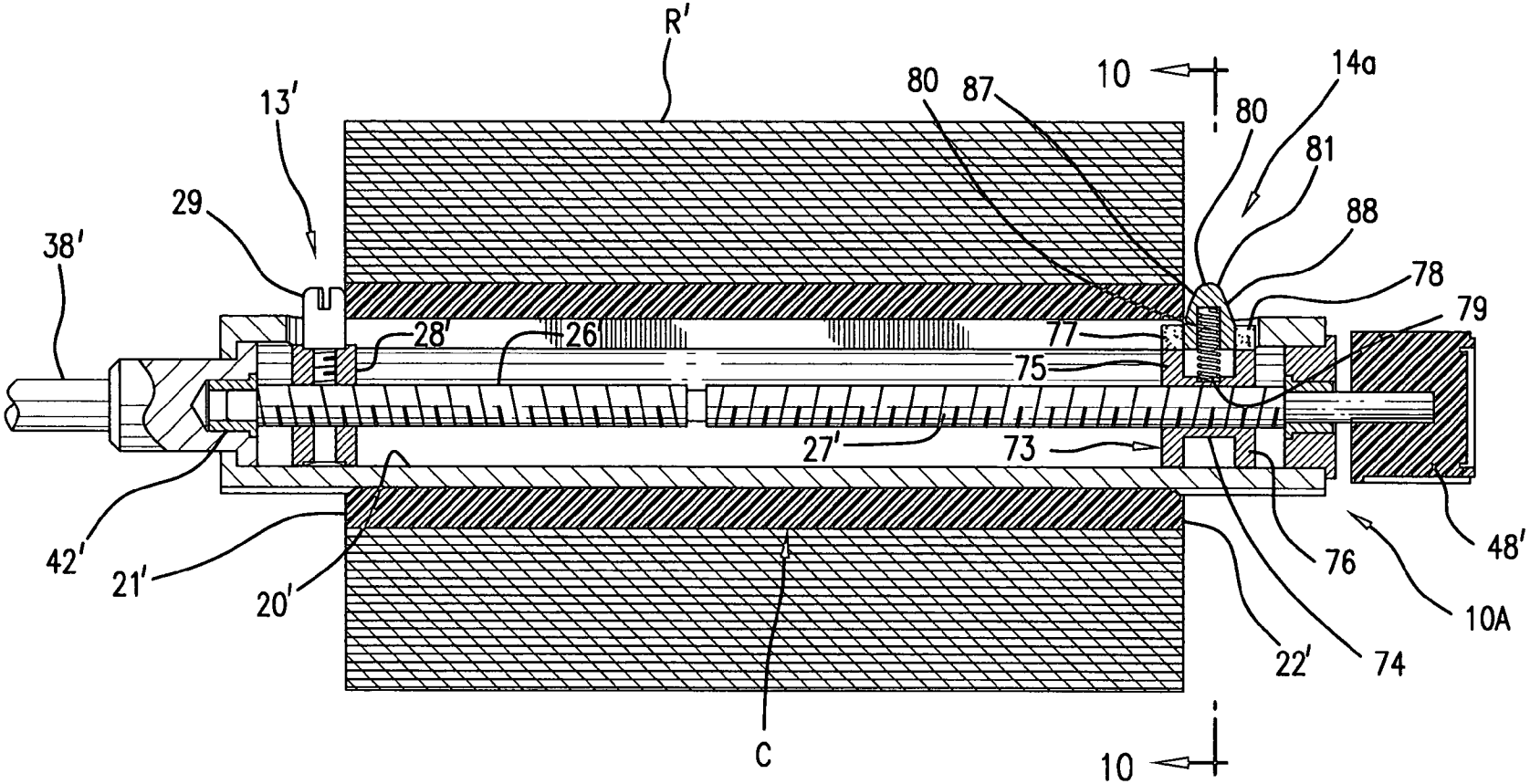
FIG. 9 is a sectional view through the mounting assembly, and the roll which it mounts, of the embodiment of FIG. 8 wherein the roll is center-justified with respect to the print head.
Figure 10:
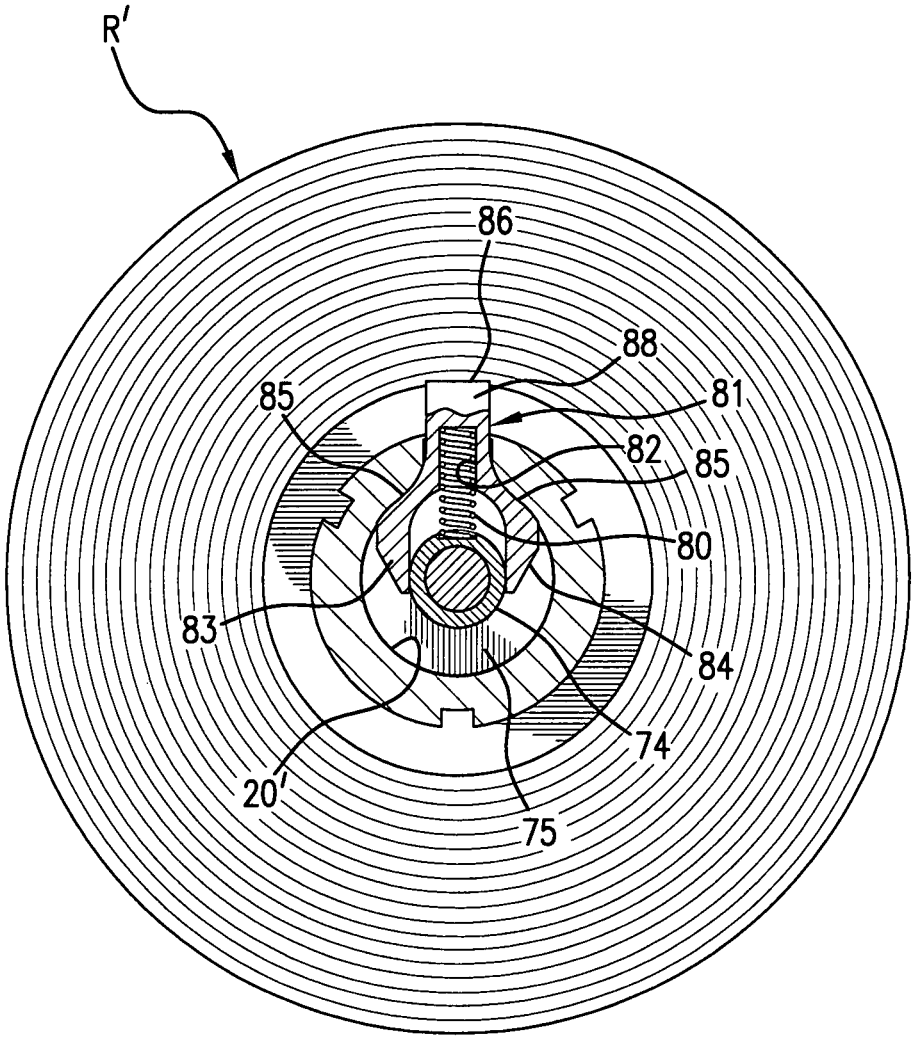
FIG. 10 is a sectional view taken along line 10-10 of FIG. 9.

In the embodiment of FIGS. 8 through 10, the same reference characters are used to designate components having the same construction, function and relative location as in the embodiment of FIGS. 1 through 7, with the addition of a prime symbol (')). Accordingly, description of components with primed numbers need not be repeated. In the embodiment of FIGS. 8 through 10, the mounting assembly is designated as 10A. Support 11*a* is identical to the support 10 except that the support 10*a* has a slot 12*a* which is closed at both ends, namely the slot 12*a* terminates at end portion 45'. A yieldable stop 14*a* is mounted on the threaded portion 27' of the shaft 25'.

With reference to FIGS. 8 through 10, the stop 14*a* includes a one-piece, spool-shaped nut or block 73. The nut 73 has a threaded hole 73*h* which receives the threaded portion 27'. The nut 73 has a hub portion 74 integrally joined to a pair of spaced, parallel discs or flanges 75 and 76. The flanges 75 and 76 have tangs or tabs 77 and 78 received in the slot 12*a*. The tabs 77 and 78 prevent rotation of the nut 73 relative to the support 10*a* but enable the nut 73 to be guided in and by the slot 12*a* as the knob 48' is rotated. The hub 74 has a recess 79 which receives a compression spring 80. With reference to FIG. 10, a plunger 81 has a recess 82 which receives the spring 80. The spring 80 may be under slight compression in its position shown in FIGS. 9 and 10. The plunger 81 and the spring 80 act as a detent. The plunger 81 can have a pair of legs 83 and 84 that straddle the hub 74. The plunger 81 has shoulders 85 that bear against the inner surface 20' to limit outward movement of the plunger 81. A core-engageable tooth 86 of the plunger 81 is received and guided for axial movement in and by the slot 12*a*. The flanges 75 and 76 and the slot 12*a* help mount the plunger 81 for radial inward and outward movement. The tooth 86 has cam surfaces 87 and 88 between which there is a smooth transition.

When loading the roll R' onto the mounting assembly 10A, the terminal end 21 of the core C contacts the cam surface 88 of the plunger 81 to move the plunger 81 radially inward to compress the spring 80. With the plunger 81 depressed, the core C can ride over the plunger 81 until the terminal end 21' contacts the stop 13'. Assuming the stops 13' and 14' are in their center-justifying locations as the terminal end 21' of the core C approaches the stop 13', the terminal end 22' contacts the cam surface 87 and the plunger 81 moves to the position shown in FIG. 9. In other respects, the mounting assembly 10A operates the same as the mounting assembly 10. To unload the roll R' or the core C from the mounting assembly 10A, the user grasps the roll R' or the core C with one hand and slides it toward the knob 48' to cam or push the yieldable stop 14*a* out of the way. The core C pushes the plunger 81 out of the way to enable the roll R and/or the core C to be slid completely off the mounting assembly 10A.

Figure 11:
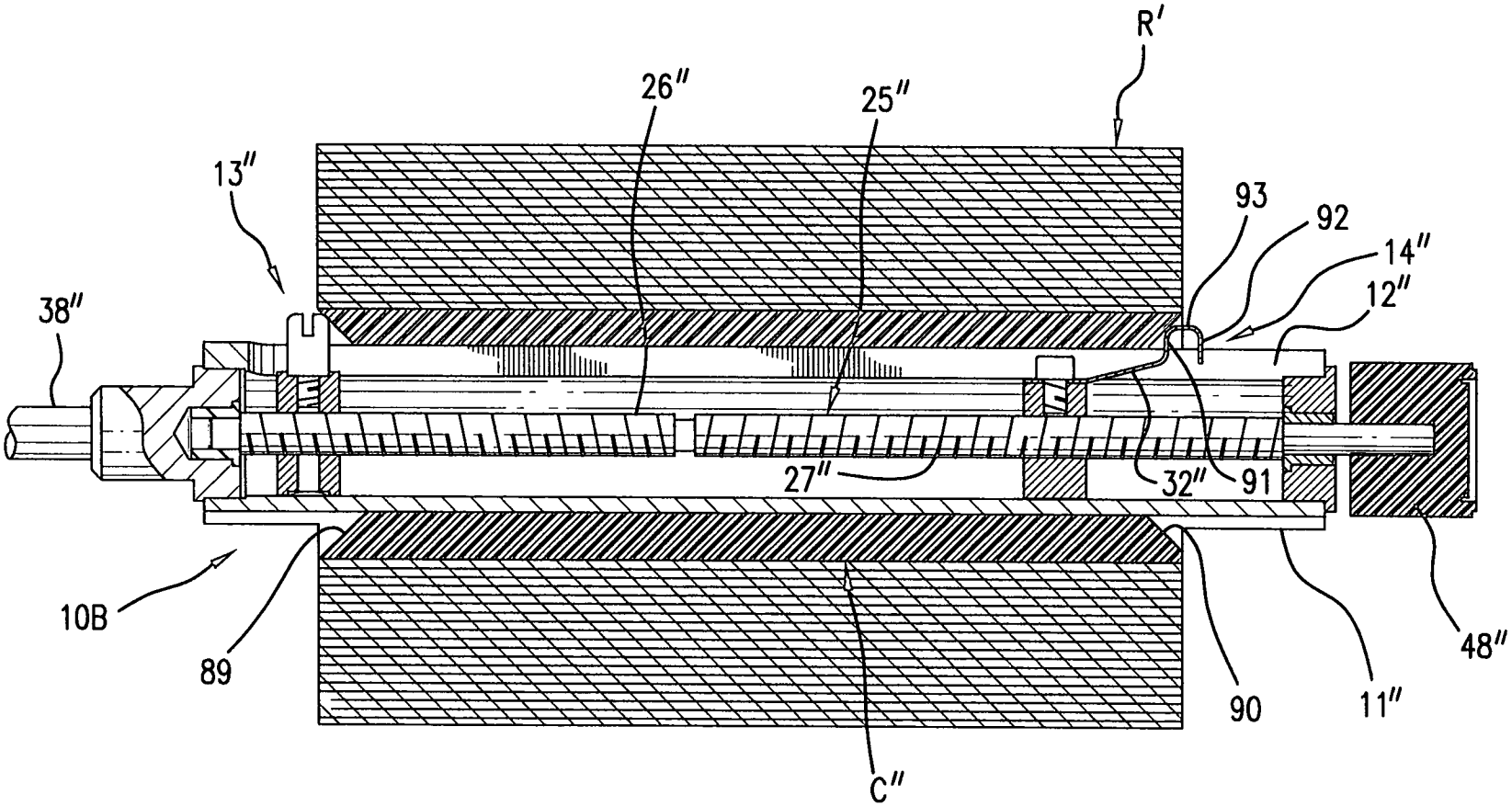
FIG. 11 is another alternative embodiment of the mounting assembly showing a core with conical terminal ends cooperating with spaced stops.

In the embodiment of FIG. 11, the same reference characters are used to designate components having the same construction, function and relative location as in the embodiment of FIG. 1 through 7, with the addition of a double prime (") symbol. Accordingly, description of double-primed numbers need not be repeated. The core C" has cone-shaped terminal ends 89 and 90 which provide respective cams or cam surfaces. The spring finger 32" has a blunt-face portion 91 and a blunt-face portion 92 joined by a dwell portion 93. In the position shown in FIG. 11, the portions 91 and 92 are generally parallel to the sides of the roll, that is, essentially vertical as seen in FIG. 11. The camming or pushing of the stops 13" and 14" is accomplished by the end portion 89 cooperating with the portion 92 upon loading the core C" into the mounting assembly 10B, and the camming or pushing of the stop 14" is accomplished by the end portion 90 upon unloading the core C" from the mounting assembly 10B. In other respects the stop 14" operates the same as the stop 14.

In the embodiment of FIGS. 1 through 7, the terminal ends 21 and 24 of the core C can also be cone-shaped if desired, so that the core C as well as the stop 14 have cooperating camming or pushing surfaces.

In the embodiment of FIGS. 12 through 15, the same reference characters are used to designate components having the same construction, function and relative location as in the embodiment of FIGS. 1 through 7, components that differ in one or more respects are designed by different reference characters.

Figure 12:
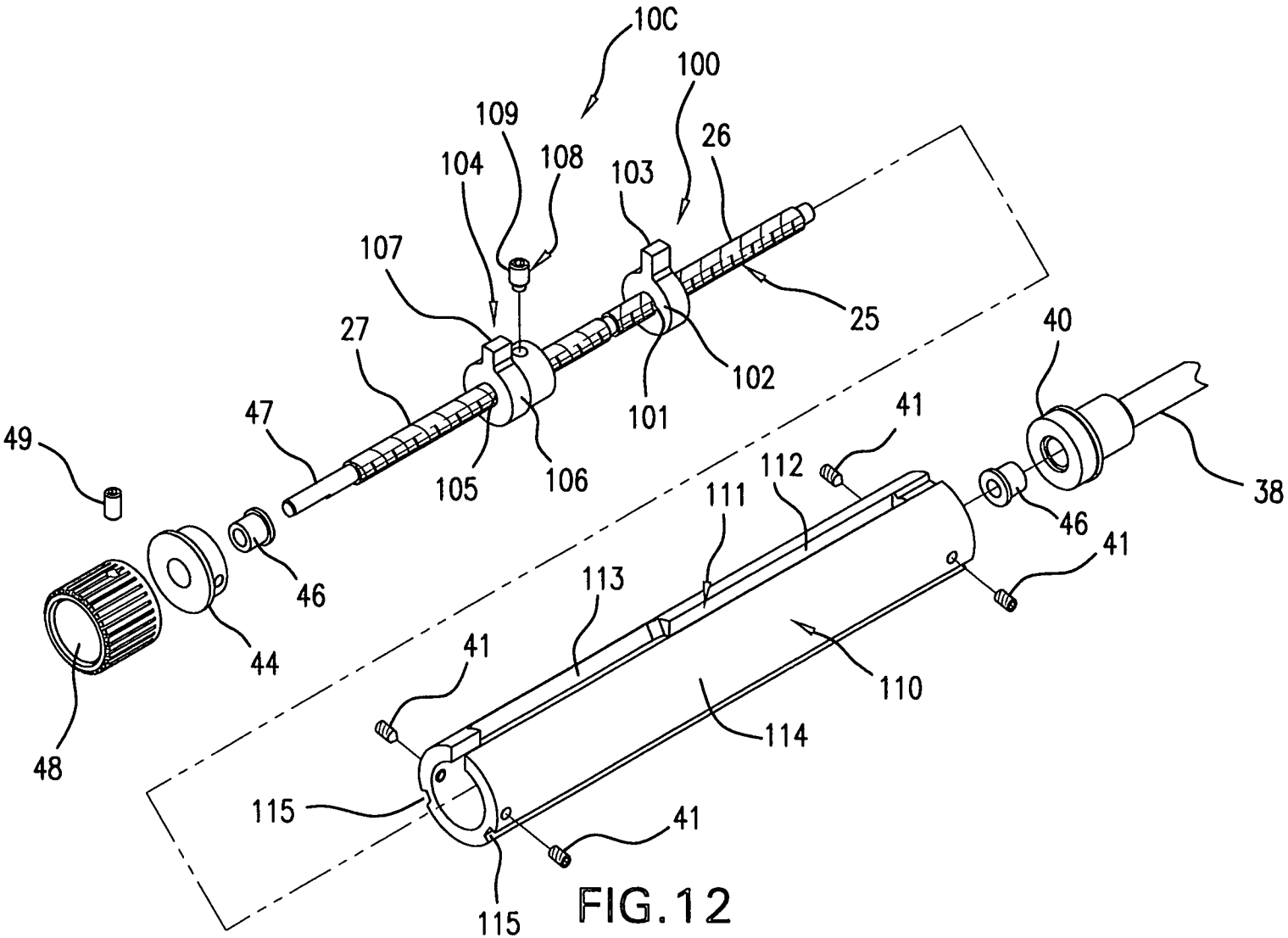
FIG. 12 is an exploded pictorial view of another embodiment of a mounting assembly.

Referring initially to FIG. 12, the mounting assembly 10C can include a stop generally indicated at 100 shown to be threadably received on the shaft portion 26 which passes through a threaded hole 101 of a generally annular hub 102. A stop member 103 is joined to the annular hub 102. The stop 100 can be machined from metal or plastics or it can be of one-piece molded plastics construction. A stop generally indicated at 104 is shown to be threadably received on the shaft portion 27 which passes through a threaded hole 105 of a generally annular hub 106. A stop member 107 is joined to the annular hub 106. A brake 108 is provided by a preferably nylon screw 109 threadably received in a threaded hole 109' in the hub 106. A support generally indicated at 110 is similar to the support 11 shown in FIG. 2, for example. One difference is that the slot 111 has a narrow slot portion 112 which is like the slot 12, but which widens as shown at a wide slot portion 113. Another difference is that outer surface 114 of the support 110 has two grooves 115 instead of three grooves 18. Two of the projections 19 on the core C fit into the grooves 115 and the third projection 19 fits into the slot 111. The core C is prevented from relative rotation by the slot portion 112. The grooves 115 and the projections 19, which cooperate with them, could be eliminated if desired.

Figure 13:
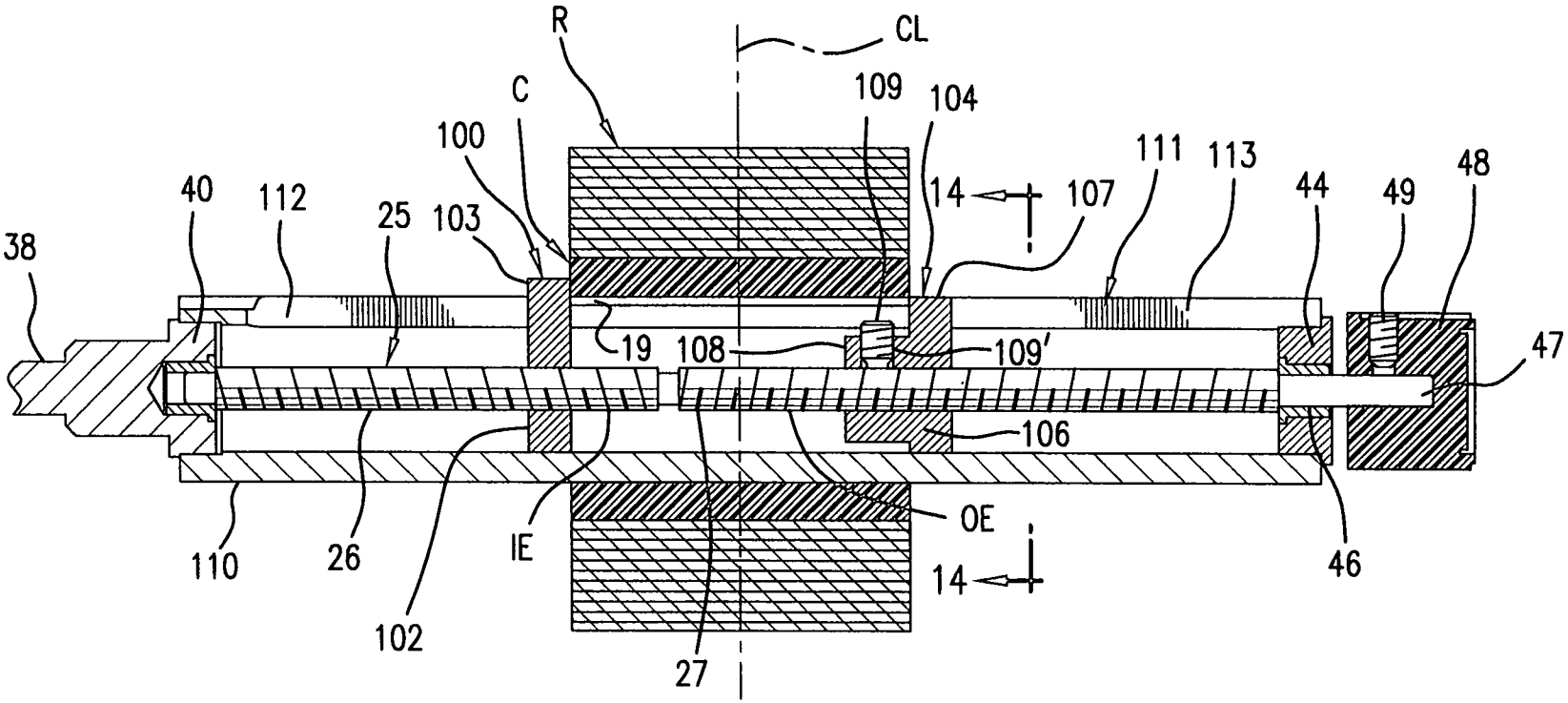
FIG. 13 is a sectional view of the mounting assembly shown in FIG. 12, but including a roll of web material and a core in center-justified position on a support.

With reference to FIG. 13, the roll R and its core C are held center-justified in the holder assembly 100. The stop member 103 is shown as being in the slot 112 and can even project outwardly beyond the surface 114 of the support 110 as shown. The stop member 107 of the stop 104 extends into the slot portion 113 but preferably not beyond the outer periphery of the support 110 as shown in FIG. 13. However, in FIG. 13, the stop 104 is shown to be in the path of the projection 19 which is in the slot portion 113 of the slot 111.

Figure 14:
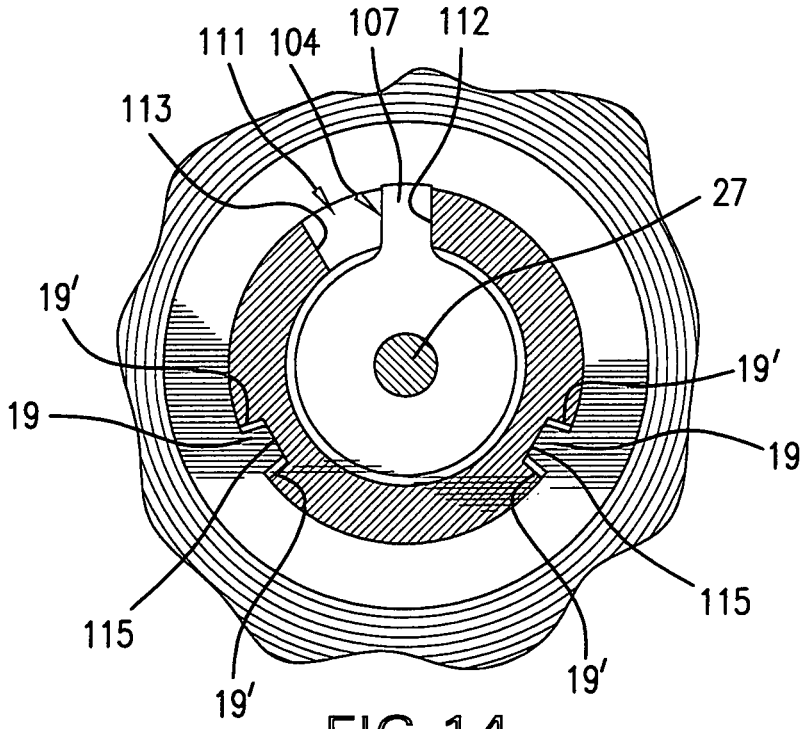
FIG. 14 is a sectional view taken along line 14-14 of FIG. 13 showing a stop in its effective position.

In FIGS. 13 and 14, the stop 104 is shown to be in its effective position aligned with the projection 19 which is in the slot 111. In this position, the core C is trapped or captive between the stops 100 and 104. When the stop 104 has been moved to the FIG. 15 position out of the path or out of alignment with the projection 19, the core C is free to be slid onto or off the support 110.

There is friction between the stop 104 and the threaded shaft portion 27. By turning the knob 48 clockwise from the position shown in FIG. 15, which may be referred to as a first position, to the position shown in FIG. 14, which may be referred to as a second position, the shaft 25 carries the stop 104 along with it. Likewise, by turning the knob 48 counterclockwise, the shaft 25 carries the stop 104 along with it from the second position shown in FIG. 14 to the first position shown in FIG. 15. In order to supplement the friction between stop 104 and the shaft position 27, the brake screw 109 serves as a brake 108, to more positively rotationally couple the shaft 25 to the stop 104. It should be noted that while the brake screw 109 is initially adjusted during manufacture, the ready accessibility of the brake screw 109 makes it easy to adjust the brake screw 109 in the event this friction is reduced due to excessive wear.

Figure 15:
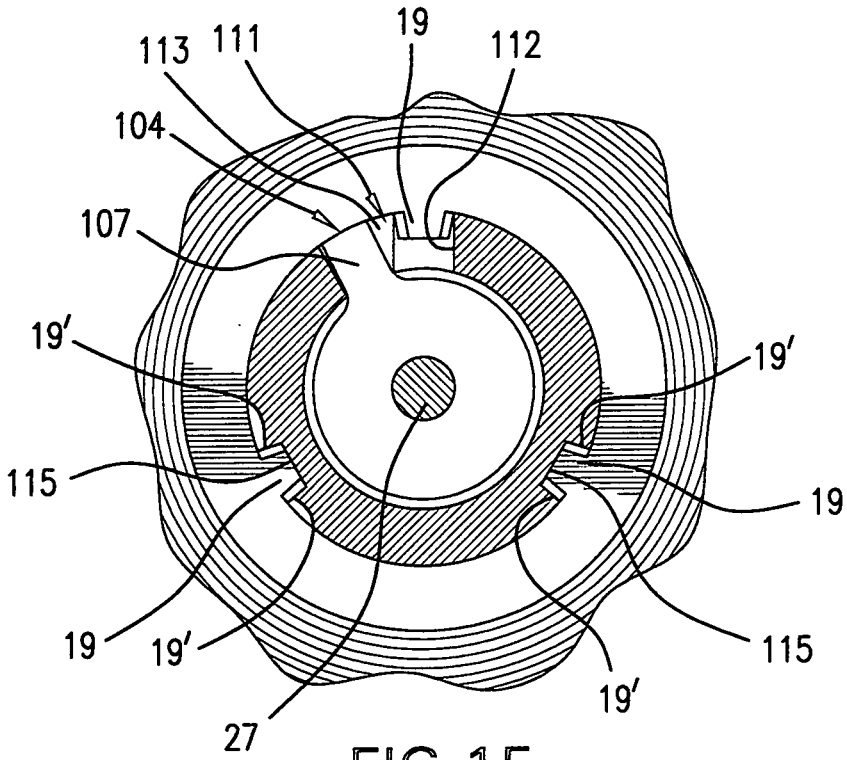
FIG. 15 is a section view like FIG. 14, but showing the stop in its ineffective position used when loading and unloading the roll.

To load a roll R onto the mounting assembly 100, the stop 104 is rotated to the first or FIG. 15 position, provided it was not already so positioned. The user simply grasps the roll R and aligns the projections 19 with the grooves 115 and the slot portion 113 of the slot 111 and manually slides the roll R onto and along the support 110 until the core C is stopped by the stop 100. It is noted that because the stop 104 extends to but not beyond inner surface 20 of the core C, the stop 104 does not interfere with sliding the roll R onto the support 110. While the core C is preferably inserted over the support 110 into contact with the stop 100 it could be moved to a position short of the stop 100 provided the stop 104 was at an outward position far enough for the core C to clear the stop 104. Assuming the core C is clear of the stop 104 in a plane perpendicular to the shaft 25, the user can rotate the knob 48 clockwise which will move the stop 104 from the first or FIG. 15 position to the second or FIG. 14 position. The stop 104 has now been brought into alignment with a projection or rib 19 on the core C which is in the slot portion 113. In the event the stops 100 and 104 are already positioned for the width of the core C which has been loaded onto the support 110 as shown in FIG. 13, the user can load the roll R onto the mounting assembly 10C without adjusting the axial positions of the stops 100 and 104. If, however, the stops 100 and 104 are spaced apart more widely than the width of the core C, then the user can continue to turn the knob 48 clockwise which moves the stops 100 and 104 in unison toward each other to bring the roll R and its core C into center-justified position with respect to centerline CL of the print heads 53' and 55' and to the unwind 52. During such continued clockwise movement of the knob 48 and the shaft 25, the shaft 25 rotates, the stops 100 and 104 translate along the respective slot portions 112 and 113 and the brake 108 slips to allow the clockwise rotation of the shaft 25 relative to the stop 104. It is noted that the brake 108 helps prevent relative rotation between the stop 104 and the threaded portion 27 when the stop 104 is being moved between the first and second positions. The brake 108, however, allows the shaft 25 to be rotated relative to the stop when the knob 48 is turned to cause the stops 100 and 104 to translate in the axial direction either toward or away from each other. In order to unload the roll R or a spent core C from the mounting assembly 10C, the user rotates the knob 48 counterclockwise to bring the stop 104 to the FIG. 15 position, whereupon the roll R or the spent core C can be slid off the support 110.

In all the embodiments of the mounting assemblies 10, 10A, 10B and 10C, the roll R and its core C, C' or C" can be edge-justified, if desired by making the shaft portion 26 free of threads (not shown) and by positioning the stop 13, the stop 13', the stop 13", or the stop 100, as the case may be, rotatable on the shaft portion 26 between a pair of E-rings (not shown) received in axially spaced annular grooves (not shown) in the shaft portion 26. In this way the stop 14, the stop 14*a*, the stop 14" or the stop 104 as the case may be can be moved axially toward or away from the stop 13, 13' or 13" or 100 which is prevented from moving axially by the E-rings.

The cores C, C" and the knob 48, 48' 48" are shown to be comprised of molded plastics material, however, all the mounting assemblies 10, 10A, 10B and 10C can be constructed of molded plastics material except for the spring 80 and perhaps various screws. Alternatively, some of the other parts can be made of plastics material and others can be made of metal.

Although the mounting assemblies 10, 10A, 10B and 10C are illustrated for use with webs I of ink ribbons, they can also be used with webs of a wide variety of other material such as paper, fabric, film or the like.

Other embodiments and modifications will suggest themselves to those skilled in the art, and all such of these as come within the spirit of this invention are included within its scope as best defined by the appended claims.

We claim:

1. A mounting assembly, comprising:

a cantilevered support having an inner end portion and an outer end portion, the support being slotted and capable of slidably receiving and mounting a core with internal projections for web material, a threadable first stop at the inner end portion, a second stop at the outer end portion, having a deflector and threaded portion, the deflector cantilevered to the threaded portion and removable, wherein the second stop is deflectable and includes a first engageable surface, the core being positionable between and in contact with the first stop and the first engageable surface of the second stop, and wherein the core cooperates with the first engageable surface to operatively deflect the second stop in response to an action of sliding the core off the support;

an axially extending shaft within the support and having oppositely threaded portions, and wherein the first stop and second stop automatically adjust on the axially extending shaft and the first and second stops remain stationary in response to an action of sliding the core off the support and sliding the core onto the support.

2. A mounting assembly as defined in claim 1, wherein the second stop includes a second engageable surface, wherein the core cooperates with the second engageable surface and deflects the second stop upon sliding the core onto the support.

3. A mounting assembly as defined in claim 1, wherein the first and second stops are coupled to move in unison to center-justify cores of different widths.

4. A mounting assembly as defined in claim 1, in a printer having a print head.

5. A mounting assembly as defined in claim 1, wherein the second stop includes a spring finger.

6. A mounting assembly as defined in claim 2, wherein the second stop includes a detent.

7. A mounting assembly as defined in claim 1, the support having an axis, an axially extending shaft within the support and having oppositely threaded portions, wherein the first stop is threadably mounted on one of the threaded portions, and wherein the second stop is threadably mounted on the other threaded portion.

8. A mounting assembly as defined in claim 7, in a printer having a print head, wherein rotation of the shaft can center-justify cores of different widths with respect to the print head.

9. A mounting assembly as defined in claim 1, wherein the support is rotatably mounted.

10. A mounting assembly as defined in claim 1, wherein the first engageable surface is a cam surface.

11. A mounting assembly as defined in claim 2 wherein the second engageable surface is a cam surface.

12. A mounting assembly as defined in claim 10, wherein the second engageable surface is a cam surface.

13. A mounting assembly as defined in claim 1, wherein the core has a cam surface engageable with the first engageable surface to cam the yieldable stop out of the way as the core is slid off the support.

14. The mounting assembly of claim 1, wherein the cantilevered support having a slot, the pair of stops are disposed along the slot, and a manually-engageable knob, wherein the knob is capable of uniformly moving the stops in relative motion.

* * * * *